US005100008A

United States Patent [19]

O'Herron

[11] Patent Number: 5,100,008

[45] Date of Patent: Mar. 31, 1992

[54] UTILITY HANGER

[76] Inventor: John E. O'Herron, 15001 Twelve Mile Rd., Warren, Mich. 48093

[21] Appl. No.: 614,229

[22] Filed: Nov. 15, 1990

[51] Int. Cl.[5] ..... A47F 5/00

[52] U.S. Cl. ..... 211/106; 211/88; 211/119

[58] Field of Search ..... 211/113, 118, 87, 88, 211/106, 119

[56] References Cited

U.S. PATENT DOCUMENTS

| | | | |
|---|---|---|---|
| 216,008 | 5/1879 | Wilson . | |
| 359,953 | 3/1887 | Atwood . | |
| 480,242 | 8/1892 | Bankson . | |
| 511,238 | 12/1893 | Hieatzman . | |
| 1,035,740 | 8/1912 | Raes . | |
| 1,409,800 | 3/1922 | Turner . | |
| 1,439,302 | 12/1922 | Erickson . | |
| 1,446,382 | 2/1923 | Dwight . | |
| 1,509,390 | 9/1924 | Bishop . | |
| 1,851,220 | 3/1932 | Tarbox . | |
| 2,316,053 | 4/1943 | Davis . | |
| 2,423,455 | 7/1947 | Larson . | |
| 2,628,723 | 2/1953 | Booth et al. | 211/118 X |
| 2,900,692 | 8/1959 | Lincoln . | |
| 3,032,205 | 5/1962 | Reed et al. . | |
| 3,032,305 | 5/1962 | Mittenzwei . | |
| 3,104,087 | 8/1963 | Budnick et al. . | |
| 3,162,413 | 12/1964 | Hexdall . | |
| 3,517,417 | 6/1970 | Kachel . | |
| 3,809,358 | 5/1974 | Hazeley . | |
| 4,236,688 | 12/1980 | Wilk . | |
| 4,238,098 | 12/1980 | Siegfried et al. . | |
| 4,804,094 | 2/1989 | Eittreim | 211/88 |
| 4,840,279 | 6/1989 | Cobb et al. | 211/88 |

*Primary Examiner*—Robert W. Gibson, Jr.
*Attorney, Agent, or Firm*—Dykema Gossett

[57] ABSTRACT

A storage system is disclosed which utilizes the space between adjacent joists or wall studs. A preferred embodiment is disclosed in which a hanger is attached between adjacent floor joists and has hooks driven into the floor joists to securely retain the hanger between the floor joists. Due to the unique structural arrangement of the hanger, it is ensured that great weights placed on the hanger will only drive the hooks further into the joists, thus ensuring that the hanger would not break off of the joists.

19 Claims, 2 Drawing Sheets

UTILITY HANGER

BACKGROUND OF THE INVENTION

The present invention relates generally to a storage system which spans the distance between adjacent floor joist or wall stud. More particularly, the present invention relates to such a storage system constructed such that a prestress is created, securely retaining it on the joists.

Storage systems are becoming increasingly popular. Residential, industrial and office environments are often faced with space shortages and it becomes necessary to efficiently use available space to store items. As an example, the space between adjacent structural frame members such as floor joists or wall studs is often not utilized for any purpose. It would be desirable to create a storage system which can be utilized to store items in this space which is easily removable and adjustable along the frame members. Further, it would be desirable to disclose such a system which is prestressed onto the frame members to ensure that it does not break away should a overly large weight be placed on the system.

There are prior art devices which are utilized to attach various items to wooden members. As an example, U.S. Pat. No. 4,236,688 disclosed an anchoring device which can be used to attach articles to a wooden stud. The device includes a pair of hooks which are biased into the stud since they have a relaxed distance that is less than the thickness of the stud. This item may be somewhat useful in attaching or hanging items to a single stud, however, it is not particularly useful in storing items in the space between adjacent frame members.

U.S. Pat. Nos. 3,104,087 and 3,162,413 disclose devices which extend between two adjacent wooden members. These devices are not necessarily used for storage, nor are they spring biased to secure the devices to the wooden members. Instead, they are incrementally adjusted into the wooden members.

U.S. Pat. No. 1,446,382 discloses a device for attaching a step to a ladder in which securing members are attached to outer faces of the ladder sides. This structure does not have a spring force holding the step to the ladder, nor could it be called a storage member.

It is an object of the present invention to disclose a storage member which spans the distance between floor joists or wall studs, and supports items to be stored in the space between the two. It is further an object of the present invention to disclose such a structure that is securely retained on the joist or stud, but at the same time may be easily removed.

SUMMARY OF THE INVENTION

In a disclosed embodiment of the present invention, a storage member comprises a base portion which spans the distance between a pair of adjacent structural frame members. The storage member preferably has a pair of lateral sides with each side including a hook extending laterally inwardly towards the base portion. In a relaxed position, the distance between the laterally innermost ends of each hook is preferably less than the distance between the outer faces of the adjacent structural frame members. Thus, when the storage member is placed over the adjacent joist, the hook members are driven outwardly of the relaxed position. This creates a stress in the base portion which tends to force the hook members further into the frame members.

In a preferred embodiment of the present invention, the storage member comprises a hanger attached across adjacent floor joists in which the hook members extend laterally inwardly and downwardly from an upper side member. The upper side member is in turn connected to an angled lower side member which extends laterally inwardly and downwardly to the base. The angled lower side member is connected to the base at a pivot point. Any weight placed on the base tends to pivot the angled lower sides about the pivot points and force the hooks further into the joists.

In a preferred embodiment, the base is bowed upwardly when first received across the distance between the joists. As items are placed on the base, it may move under the influence of the weight of the items such that it is no longer bowed, but extends along a straight line. If additional weight is placed on the base, it may move to a position such that it is bowed downwardly. As the base moves through these positions, it forces the hook members further into the joists such that the storage member is even more securely attached.

A mounting system is also disclosed that comprises a pair of hangers spanning the distance between a pair of adjacent floor joists. The hangers are spaced from each other by an axial distance and allow items to be placed upon each hanger and extend along that axial distance while being fully supported between the floor joists. This embodiment efficiently utilizes the space between the joists for storage.

The present invention efficiently utilize available space which is typically not used. Further, the unique structure of the storage systems ensure that they will not break away from the structural frame members, but instead that they become even more securely attached to the structural frame members as heavier weights are placed upon them.

These and other objects and features of the present invention can be best understood from the following specification and drawings of which is a brief description.

DETAILED DESCRIPTION OF THE PREFERRED EMBODIMENT

Figure 1:
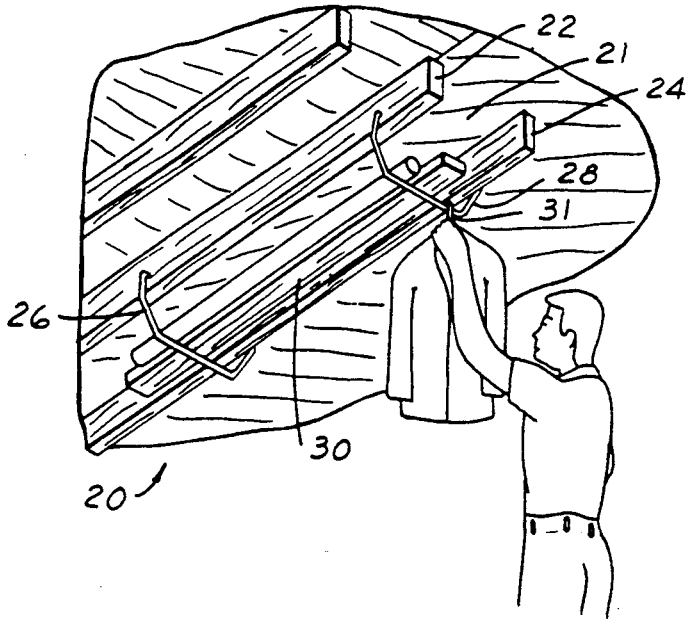
FIG. 1 is a perspective view showing a mounting system according to the present invention.

A storage system 20 illustrated in FIG. 1 utilizes space 21 defined between a pair of adjacent floor joist 22 and 24. A pair of hangers 26 and 28 span the distance between joist 22 and 24 and support a number of items 30 in space 21. Storage system 20 thus utilizes space 21 which is not normally used for storage. Coat hanger 31, or other similar hooked items may also be attached to hangers 26 and 28 for storing other items such as clothing. As an example, a single hanger 26 could be placed above an ironing area, and the ironed clothes could be hung on hanger 26.

Figure 2:
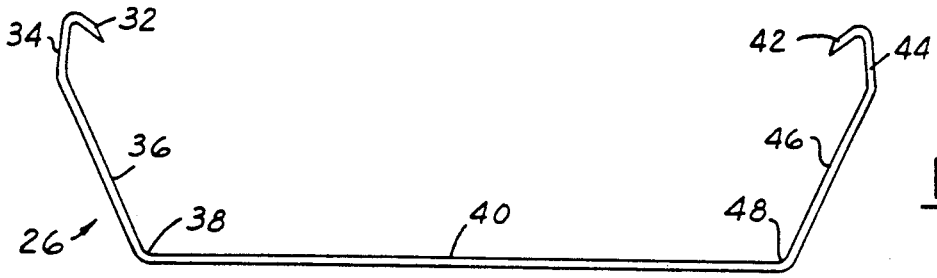
FIG. 2 is a side view of a hanger according to the present invention.

FIG. 2 shows details of hanger 26, which includes hook 32 extending from an upper side member 34, which is in turn connected to an angled lower side member 36 connected at pivot point 38 to base 40. As can be seen, hook 32 extends at an angle in a direction inwardly and downwardly from upper side 34 towards base 40. The angle will cause the hooks to be biased into a frame member 22 by any weight supported on base 40. Further, angled lower side 36 extends at an angle inwardly and downwardly from upper side 34 to base 40.

Similarly, hook 42 is received in joist 24 and connects upper side 44 and angled lower side 46 through pivot point 48 to base 40. Thus, base 40 is connected through pivot points 38 and 48 to the sides of hanger 26. Base 40 extends along a straight line between pivot points 38 and 48 when in the illustrated relaxed position.

Figure 3A:
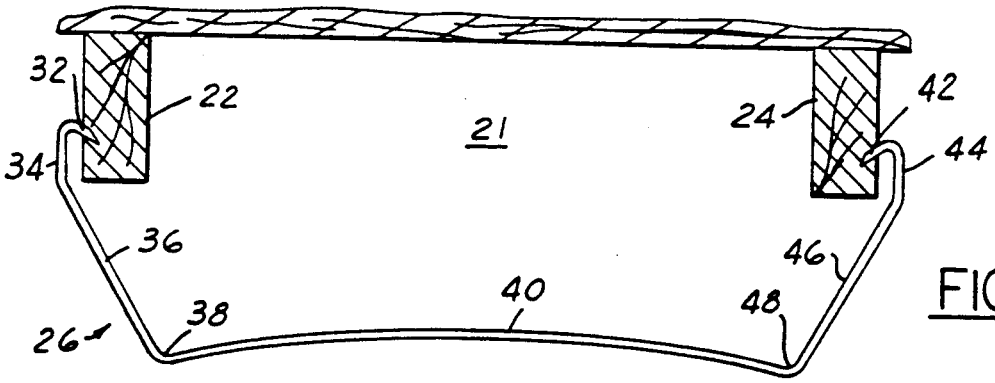
FIG. 3A is a cross-sectional view showing a hanger according to the present invention.

As shown in FIG. 3A, base 40 is bowed upwardly due to a prestress caused by attaching hanger 26 to joists 22 and 24. It should be understood that if hanger 26 were removed from joists 22 and 24, hooks 32 and 42 would move laterally inwardly and base 40 would move to the position illustrated in FIG. 2 in which it extends along a straight line between pivot points 38 and 48. Upper sides 34 and 44 would then preferably be generally perpendicular to base 40.

In an unstressed or relaxed position, the distance between the laterally innermost points of hooks 32 and 42 is less than the distance between the outer faces of joists 22 and 24. The distance between the centers of joists 22 and 24 is set at a standard 16 inches. Of course, there may be variations in this distance due to misplacement of the joist. Further, the thickness of the joist may vary. For this reason, the distance between the outside faces of floor joists 22 and 24 to which hooks 32 and 42 are attached, can vary. The outer faces of floor joists can be approximated as being 17½ inches apart, although as noted above, that dimension may vary somewhat. The distance between the innermost points of the two hooks is preferably ⅝ to ¾ inches shorter than the distance between the joists, in one embodiment the distance is 16¾ inches. More preferably, the base 40 is fourteen inches long when used between two adjacent floor joists. Further, the hanger is most preferably made out of a low-carbon steel wire.

Thus, when hanger 26 is received on joists 22 and 24, the hooks 32 and 42 are forced laterally outwardly from their unstressed position. The stress created by this force is passed through upper side 34 and 44 and into angled lower sides 36 and 46. Thus, a force is transmitted through pivot points 38 and 48 forcing them laterally inwardly and downwardly. The reaction to this force causes base 40 to bow upwardly. A resistance force to this bowing of base 40 forces hooks 32 and 42 laterally inwardly such that they are driven into joists 22 and 24.

Figure 3B:
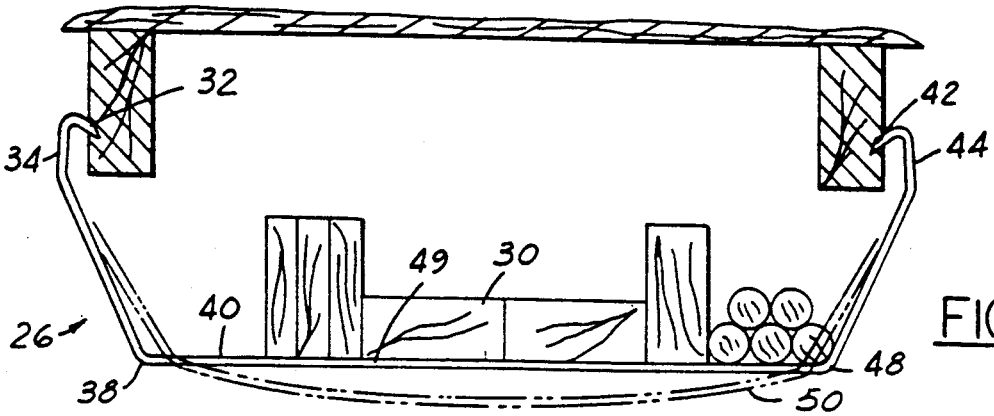
FIG. 3B is a view similar to FIG. 3A, but showing the hanger supporting several items.

As shown in FIG. 3B, items 30 are placed on hanger 26. If sufficient weight is received on hanger 26, base 40 is forced vertically downwardly to the unbowed position shown at 49. The pivot points 38 and 48 are forced slightly laterally outwardly and they rotate the sides such that hooks 32 and 42 are forced further into joists 22 and 24. This further ensures that hanger 26 will not be removed from joists 22 and 24, but will continue to adequately support items 30. If the weight of items 30 is increased even further, base 40 may move to a bowed downward position 50, shown in phantom. This will force hooks 32 and 42 even further into joists 22 and 24 and ensure that hanger 26 will remain attached to the joist. Thus, additional weight will not tend to break hanger 26 from joists 22 and 24, but instead will ensure that hanger 26 remains secured to joists 22 and 24.

When mounting hanger 26, it is preferable that the hanger is placed about 1½ inches up onto the joist to provide an adequate support area. Further, most preferably, a first hook is initially placed on a joist and the other hook is then sprung outwardly about ⅝ of an inch to be placed onto the adjacent joist. A user then tugs with both hands on each side of hanger 26 to set hooks 32 and 42 into the adjacent joists. Most preferably, one should avoid placing hooks 32 and 42 on knots or porous areas in the wood, as they may give way.

Should the user desire to move the location of hanger 26, hooks 32 and 42 may be easily removed by first removing one from joist 22 and 24 and then pivoting the entire hanger 26 and removing the second. Further, should the distance between adjacent floor joists 22 and 24 vary such that the distance between hooks 32 and 42 is either too small or too large, angled lower sides 36 and 46 can be bent about pivot points 38 and 40 relative to base 40 to compensate for the different dimension. This can also be done to accommodate the loss of spring force as hangers 26 age.

Figure 4:
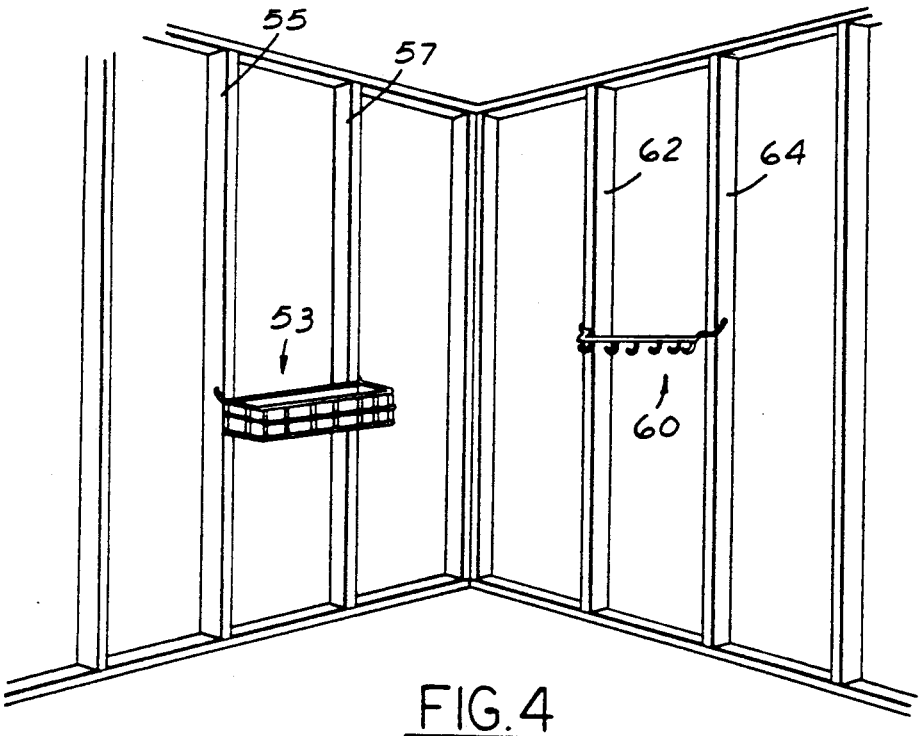
FIG. 4 is a perspective view showing second and third embodiments of the storage system disclosed in FIG. 1.
Figure 5:
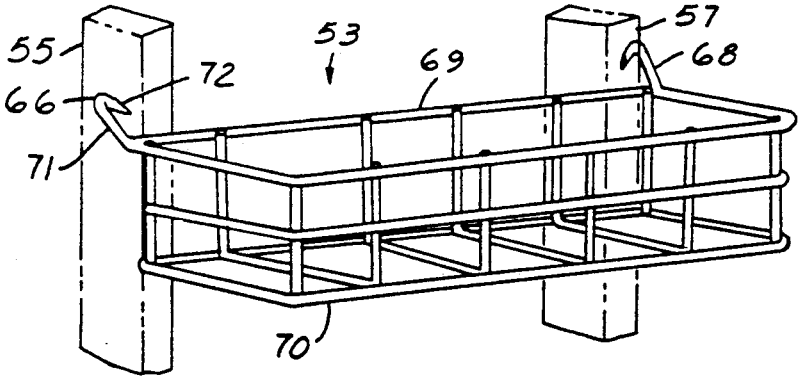
FIG. 5 is an enlarged perspective view showing the second embodiment of the present invention.
Figure 6:
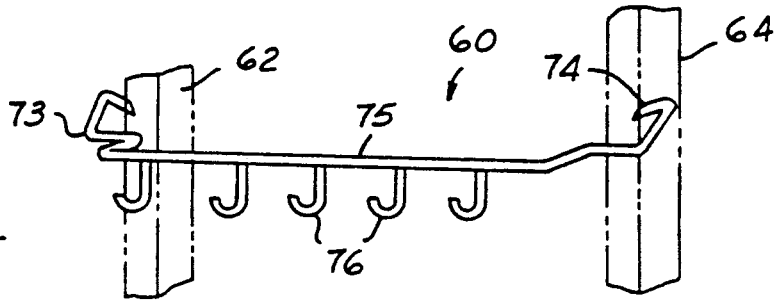
FIG. 6 is an enlarged perspective view showing the third embodiment of the present invention.

Alternative embodiments of the support system of the present invention are shown in FIGS. 4–6. As shown in FIG. 4, a first alternative 53 may be attached across adjacent wall studs 55 and 57. A third embodiment 60 is shown extending between wall studs 62 and 64.

FIG. 5 shows details of second embodiment 53, which includes hooks 66 and 68 received in wall studs 55 and 57 and connected by base 69 to support basket 70. The distance between hooks 66 and 68 is less than the outside distance between wall studs 55 and 57 such that hooks 66 and 68 are driven into studs 55 and 57. Further, hook 66 consists of first portion 71 and a second hook portion 72, which is angled laterally inwardly from portion 71. Thus, if items are placed in basket 70, the weight tends to drive hook portion 72 further into stud 55.

A third embodiment 60 is illustrated in FIG. 6. Hook member 73 is received in wall stud 62 while hook member 74 is received in wall stud 64. Base 75 extends between hook 73 and 74 and includes a plurality of hooks 76 to receive and support items. Again, the distance between hook 73 and 74 is selected such that it is less than the outside distance between wall studs 62 and 64, and hook 73 and 74 tend to be driven inwardly by a spring force.

Embodiments 53 and 60 are attached to wall studs similar to hangers 26. Since the distance between the hooks in the second and third embodiments is less than the distance between the outside faces of the wall studs they are driven into the studs and will adequately secure any items they are supporting.

Although the storage systems 20, 53 and 60 are shown extending across only one adjacent structural frame members, it should be understood that similar items could extend across a plurality of joists or studs and still come within the scope of this invention. Further, although specific uses and items to be stored are illustrated, it should be understood that this is in no means limiting to the scope of this invention.

In a most preferred embodiment of the present invention, protectors may be placed on the sharpened hook member when not in use to avoid injury. Further, the base and side portions may receive a plastic coating to protect them.

In one preferred embodiment of hanger 26, the wire was 3/16 inches in diameter. The upper sides were 1.38 inches, while the total sides extended 5.25 inches in a direction away from the base, and the outer dimensions between the sides was 18.9 inches. The hooks extended at a 30 degree angle from the upper sides while the angled lower sides extended at a 30 degree angle from the base.

Preferred embodiments of the invention have been disclosed, however, a worker of ordinary skill in the art would realize that certain modifications will come within the scope of this invention and thus the following claims should be studied in order to determine the true scope and content of the present invention.

I claim:

1. A hanger member comprising:

a base for spanning the distance between a pair of structural frame members;

a pair of lateral sides connected at a first end to a lateral end of said base, said lateral sides extending upwardly from said base;

a pair of securing members extending laterally inwardly from a second end of said lateral sides, said securing members each having a laterally innermost position, and wherein the distance between said laterally inward most positions of said securing members is less than the distance between the lateral outward sides of a pair of structural frame members, such that if said hanger is attached to a pair of structural frame members with said securing members secured to the outward faces of the structural frame members, and with said base spanning the distance between said structural frame members, a prestress is created in said base by said securing members being forced beyond their normal position;

said structural frame members over which said hanger spans are two adjacent structural frame members.

2. A hanger as recited in claim 1, wherein said securing members extend at an angle from said lateral side member laterally inwardly and also in a direction towards said base.

3. A hanger member as recited in claim 2, wherein the prestress causes said base to bow upwardly.

4. A hanger as recited in claim 1, wherein the prestress causes the base to bow upwardly.

5. A hanger as recited in claim 1, wherein said hanger is made of steel wire.

6. A hanger as recited in claim 1, wherein the structural frame members are floor joists.

7. A hanger as recited in claim 6, wherein the joists are adjacent.

8. A hanger as recited in claim 1, wherein said lateral sides comprises a first section extending at an angle generally laterally outwardly and away from said base.

9. A hanger as recited in claim 8, wherein a second section extends generally perpendicular to said base from said first section, said securing members extending at an angle laterally inwardly and downwardly from said second section toward said base.

10. A hanger as recited in claim 1, wherein said base mounts a basket to hold items and said structural frame members are wall studs.

11. A hanger as recited in claim 1, wherein said base mounts a number of hooks to support items and said structural frame members are wall studs.

12. A mounting system comprising:

a pair of floor joists spaced laterally by a first distance measured between the lateral faces of each floor joist facing away from the other floor joist;

a pair of hangers each spanning the distance between said floor joists and having securing members received on the lateral face of each said floor joist facing away from the other floor joist; and said securing members being spaced from each other in a relaxed position by a second distance that is less than said first distance such that said securing members are separated from each other by a distance greater than the second distance when received on said floor joists, and said hangers are secured to said floor joists by an inward prestress force as said securing members attempt to return to the relaxed position.

13. A mounting system as recited in claim 12, wherein said pair of floor joists are adjacent.

14. A mounting system as recited in claim 12, wherein said hangers comprise a base portion spanning the distance between said floor joists and a pair of lateral sides extending upwardly from said base portion, said securing members extending laterally inwardly and toward said base from said lateral sides.

15. A mounting system as recited in claim 12, wherein said base is bowed upwardly by the prestress force.

16. A mounting system as recited in claim 12, wherein each of said hangers comprise a base portion which spans the distance between said joists, a pair of lateral sides extending from said base to said securing members and wherein the prestress causes said base to be bowed upwardly.

17. A hanger as recited in claim 16, wherein said lateral sides comprise a first section extending generally laterally outwardly and upwardly from said base.

18. A hanger as recited in claim 17, wherein a second section extends generally perpendicular to said base from said first section, said securing members extending laterally inwardly and downwardly from said upper sides toward said base.

19. A hanger member comprising:

a base for spanning the distance between a pair of joists;

a pair of lateral sides connected at a first end to a lateral end of said base, said lateral sides extending upwardly from said base; and said lateral sides comprise a first section extending generally laterally outwardly and away from said base, and a second section extends generally perpendicular to said base from said first section, and securing members extending laterally inwardly and downwardly from said second section toward said base, said securing members each having a laterally innermost position, and wherein the distance between said laterally inward most positions of said securing members is less than the distance between the lateral outward sides of a pair of joists, such that if said hanger is attached to a pair of joists with said securing members secured to the outward faces of the floor joists and with said base spanning the distance between said joists, a prestress is created in said base by said securing members being forced beyond their normal position.

* * * * *